US006123571A

United States Patent [19]

Craft, Jr.

[11] Patent Number: 6,123,571

[45] Date of Patent: Sep. 26, 2000

[54] CONDUCTOR STRESS RELIEF APPARATUS

[75] Inventor: Thomas Francis Craft, Jr., Hackettstown, N.J.

[73] Assignee: Lucent Technologies, Inc., Murray Hill, N.J.

[21] Appl. No.: 09/162,706

[22] Filed: Sep. 29, 1998

[51] Int. Cl.[7] ..... H01R 13/58

[52] U.S. Cl. ..... 439/463; 439/820; 439/837; 24/134 P

[58] Field of Search ..... 439/463, 820, 439/837; 24/137 P, 134 R, 132 R, 132 WL

[56] References Cited

U.S. PATENT DOCUMENTS

| | | | |
|---|---|---|---|
| 1,532,889 | 4/1925 | Davis . | |
| 1,809,532 | 6/1931 | Rolker . | |
| 2,547,080 | 4/1951 | Hebeler . | |
| 2,590,886 | 4/1952 | Pedersen . | |
| 3,171,709 | 3/1965 | Groody . | |
| 3,437,981 | 4/1969 | Keller . | |
| 3,765,061 | 10/1973 | Nash | 24/134 |
| 3,845,457 | 10/1974 | Reimer | 339/103 |
| 4,150,250 | 4/1979 | Lundeberg | 174/65 |
| 4,293,178 | 10/1981 | Lee | 339/103 |
| 4,323,725 | 4/1982 | Miller | 174/65 |
| 4,606,596 | 8/1986 | Whiting et al. | 339/107 |
| 4,766,835 | 8/1988 | Randall et al. | 114/218 |
| 4,797,125 | 1/1989 | Malana | 439/729 |
| 4,899,423 | 2/1990 | Randall | 24/134 |
| 4,952,177 | 8/1990 | Drake et al. | 439/828 |
| 5,178,559 | 1/1993 | Mello | 439/472 |
| 5,186,650 | 2/1993 | Hwang | 439/463 |
| 5,509,100 | 4/1996 | Garnett et al. | 385/136 |
| 5,620,334 | 4/1997 | Quillet et al. | 439/471 |
| 5,852,853 | 12/1998 | Pennoyer, Jr. | 24/134 |

OTHER PUBLICATIONS

U.S. application No. 09/162,218, filed Sep. 28, 1998.

*Primary Examiner*—Paula Bradley
*Assistant Examiner*—Truc Nguyen
*Attorney, Agent, or Firm*—Duane Morris & Heckscher, LLP; Steven E. Koffs

[57] ABSTRACT

A stress relief apparatus for a conductor has two bodies, at least one of which pivots so as to grip the conductor. The bodies have first and second contours, respectively. The contours face each other, so that the smallest distance between the first and second contours changes as the pivoting body pivots. First and second elastic members bias the first and second bodies, respectively, so that each of the first and second bodies engage a cable positioned between the first and second bodies. The bodies may both be pivoting bodies, and may be mirror images of one another. The contours of the bodies may have an elliptical shape. Alternatively, the bodies may have a circular shape, in which case each body pivots about a pivot point that is located at a non-zero distance from the center of that body.

14 Claims, 3 Drawing Sheets

CONDUCTOR STRESS RELIEF APPARATUS

FIELD OF THE INVENTION

The present invention is related to electrical and electronic systems generally, and more specifically to systems including cables and wires.

DESCRIPTION OF THE RELATED ART

Many systems require a stress relief mechanism for cables and other conductors connected to those systems. It is common for a single cable to include as many as one hundred conductors. Without a stress relief mechanism, many conductors would be supported mainly by the connectors to which the ends of the conductors are attached. The combined weight of the cable can cause a substantial tensile force on the conductors. Stress relief mechanisms are often necessary to prevent the conductors from being pulled out of their respective connectors by their own weight. Thus, many design specifications require that cables meet a minimum cable pull-out threshold.

Common types of stress relief in the electrical arts include: (1) a clamp member that is attached to a housing or junction box by a screw or similar fastener; (2) wire saddles; (3) tie wraps; and (4) a pair of members in a "U" or "V" shaped to grip the conductor by an interference fit.

Many product design specifications require that the conductors or cables satisfy a minimum cable pull out force criterion. This may be difficult to achieve with the above-listed stress relief devices. Although the screw-mounted clamp member can satisfy a minimum pull out force requirement, it requires a tool, takes a relatively long time to install, and is liable to damage a cable if too much torque is applied to the screw. It is more difficult to ensure that the minimum pull out force requirement is satisfied with the other three types of stress relief apparatus listed above.

An improved stress relief apparatus is desired.

SUMMARY OF THE INVENTION

The present invention is a stress relief apparatus for a conductor, having two bodies, at least one of which pivots so as to grip the conductor. The bodies have first and second contours, respectively. The contours face each other, so that the smallest distance between the first and second contours changes as the pivoting body pivots. At least one elastic member biases at least one of the first and second bodies, so that each of the first and second bodies engage a cable positioned between the first and second bodies.

DETAILED DESCRIPTION

Figure 1A:
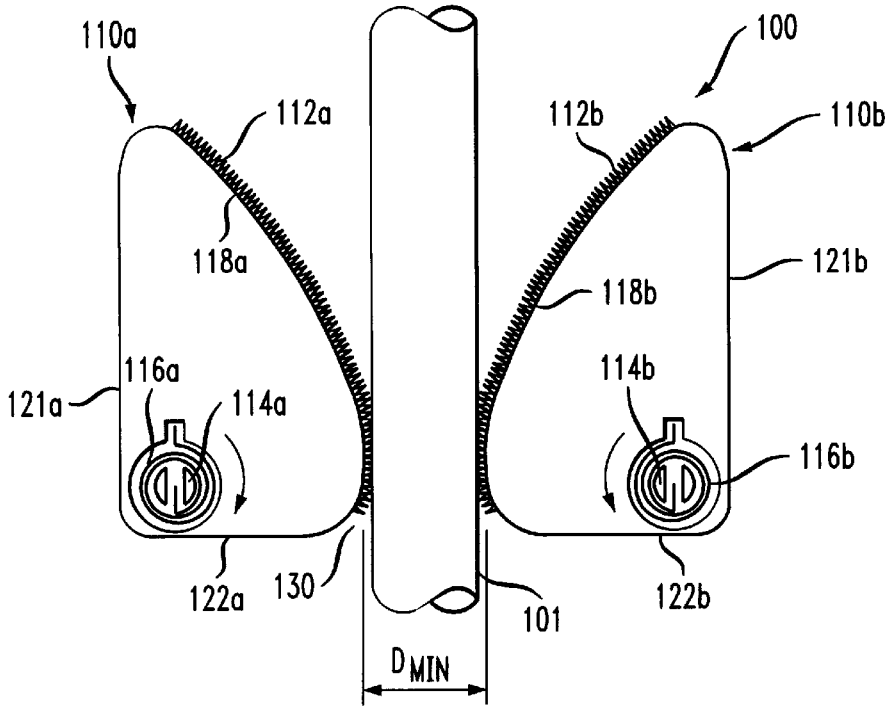
FIG. 1A is a plan view showing a first exemplary stress relief apparatus according to the invention, in a position for holding a thick cable.
Figure 1B:
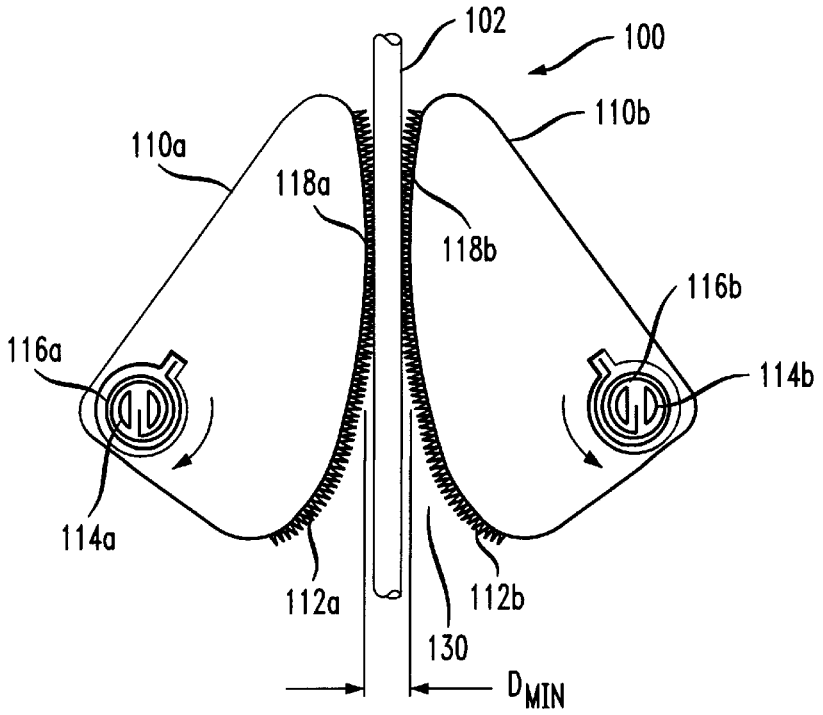
FIG. 1B is a plan view showing the stress relief apparatus of FIG. 1A, in a position for holding a thin cable.

FIGS. 1A and 1B show a first exemplary embodiment of a stress relief apparatus 100 for a cable or conductor 101.

The terms "cable" and "conductor" are used interchangeably below, because the apparatus is equally suitable for gripping a cable having plural conductors or gripping an individual conductor.

A first pivoting body 110*a* has a first contour 118*a* and a second pivoting body 110*b* has a second contour 118*b*. The contours 118*a* and 118*b* face each other, so that a smallest distance $D_{min}$ between the first and second contours 118*a*, 118*b* changes as the first body 110*a* pivots. An opposing means is provided by the second body 110*b*; the second body 110*b* pivots in the same way as the first body.

The first and second bodies 110*a* and 110*b* are pivotally mounted on first and second fixed-position studs 114*a* and 114*b*, respectively. In the example, each stud 114*a* and 114*b* is a split stud, for engaging an elastic member 116*a* and 116*b*, respectively. The first and second elastic members 116*a* and 116*b* connect the first and second bodies 110*a* and 110*b* to the first and second fixed-position studs 114*a* and 114*b*, respectively.

A first elastic member 116*a* and a second elastic member 116*b* bias the first and second pivotally mounted bodies 110*a* and 110*b*, respectively. In the example of FIGS. 1A and 1B, the first and second elastic members 116*a* and 116*b* are torsion springs, and the split studs 114*a* and 114*b* are adapted to engage the inside ends of torsion springs 116*a* and 116*b*. The torsion springs 116*a* and 116*b* are mounted in opposite directions, so that the first and second bodies 110*a* and 110*b* tend to rotate in opposite directions from each other. For example, body 110*a* tends to rotate clockwise, and body 110*b* tends to rotate counterclockwise, as indicated by the arrows in FIGS. 1A and 1B. Each of the first and second bodies 110*a* and 110*b* engage a cable 101 positioned between the first and second bodies 110*a* and 110*b*. Thus, the second body 110*b*, which opposes the pivoting first body 110*a* is also a pivoting body in the form of a mirror-image of the pivoting body 110*a*.

The elastic members 116*a* and 116*b* bias the first and second bodies 110*a* and 110*b*, so that the first and second bodies tend to rotate until the minimum distance $D_{min}$ between the first and second bodies 110*a* and 110*b* is approximately the width or diameter of the cable. In the example, each of the bodies 110*a* and 110*b* has a gripping surface comprising a plurality of gripping teeth 112*a* and 112*b*, respectively for gripping the conductor 101. Other conventional gripping edge configurations may be used for the gripping surfaces 112*a* and 112*b*. Other gripping methods and means may be used, such that the friction coefficient multiplied by the applied normal force exceeds the cable pull out requirement—for example, elastomeric pads (not shown).

To use the exemplary stress relief apparatus 100, the cable 101 or conductor 102 is inserted from the bottom end 130 of the apparatus 100. Body 110*a* pivots in the counterclockwise direction, with slight resistance from the spring 116*a*; similarly, body 110*b* pivots in the clockwise direction, with slight resistance from the spring 116*b*. Springs 116*a* and 116*b* prevent the bodies 110*a* and 110*b* from pivoting more than is needed to admit the cable 101. Once the cable is inserted, any tensile force pulling the cable out of the apparatus (downward in the Figures) is resisted by the bodies 110*a* and 110*b*. The gripping surfaces 112*a* and 112*b* prevent the cable 101 from slipping relative to the bodies 110*a* and 110*b*, so that downward movement of the cable 101 causes body 110*a* to pivot clockwise, and body 110*b* to pivot counterclockwise. This causes the bodies to grip the cable more tightly.

To intentionally remove a cable 101 from the apparatus 100, the user need only push the cable further in, to pivot body 110*a* counterclockwise and body 110*b* clockwise. The bodies 110*a* and 110*b* are then held in place while the cable 101 is removed.

The pivoting bodies may have a variety of shapes. In the example of FIGS. 1A and 1B, each of the first and second contours 118*a* and 118*b* of the respective bodies 110*a* and 110*b* approximates a quadrant of an ellipse. One of ordinary skill in the art recognizes that the shapes for the surfaces 121*a* and 122*a* of body 110*a* are not critical, as surfaces 121*a* and 122*a* do not contact the conductor 101. Similarly, the shapes of surfaces 121*b* and 122*b* of body 110*b* are not critical. For example, sides 121*a*, 122*a*, 121*b* and 122*b* may be flat, concave, or convex. Thus, a body (not shown) having two arbitrarily shaped sides could perform the same way as bodies 110*a* and 110*b*, so long as it includes a portion which approximates a quadrant of an ellipse for engaging the conductor. Moreover, a contour shaped like a quadrant of an ellipse is not required to achieve substantially the same results.

Figure 2A:
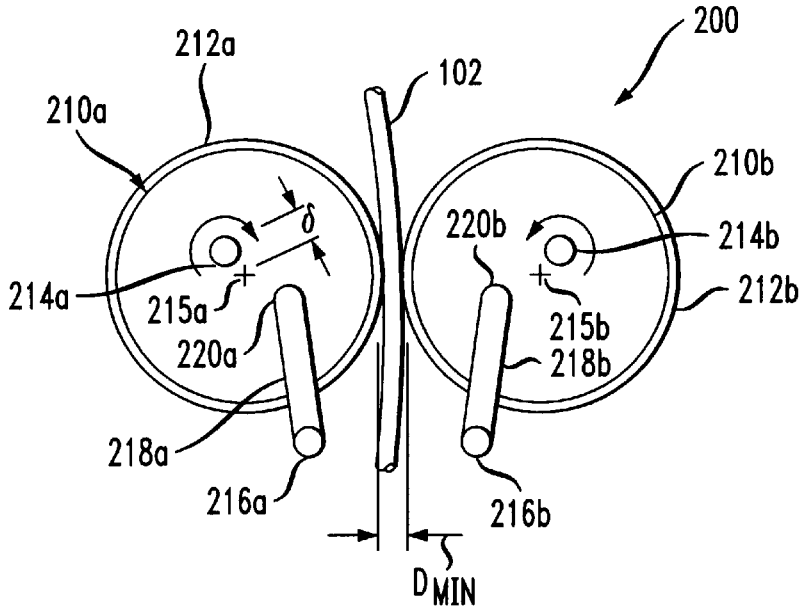
FIG. 2A is a plan view showing a second exemplary stress relief apparatus according to the invention, in a position for holding a thin cable.
Figure 2B:
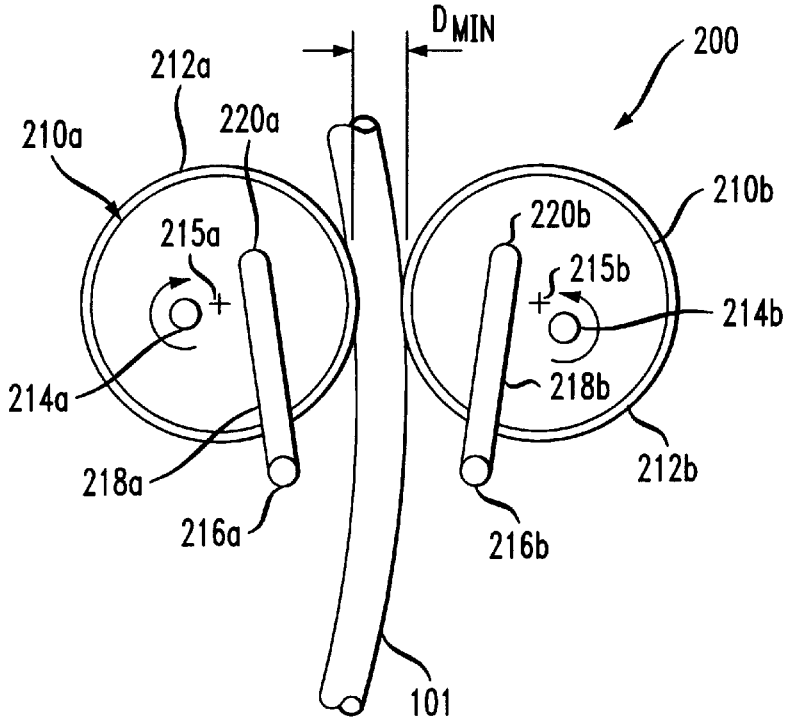
FIG. 2B is a plan view showing the stress relief apparatus of FIG. 2A, in a position for holding a thick cable.

FIGS. 2A and 2B show a second exemplary embodiment of the invention, in which the first and second bodies 210*a* and 210*b* are substantially circular. The bodies 210*a* and 210*b* pivot about fixed-position studs 214*a* and 214*b*, respectively. The first and second studs 214*a* and 214*b* are positioned at a non-zero distance δ from the centers 215*a* and 215*b* of each respective body 210*a* and 210*b*. Thus, the minimum distance $D_{min}$ between the two bodies 210*a* and 210*b* changes as the bodies 210*a* and 210*b* pivot, so as to squeeze the conductor or cable 101, 102.

In FIGS. 2A and 2B, the biasing means include linear elastic members 218*a* and 218*b*. The elastic members 218*a* and 218*b* connect a pin 220*a*, 220*b* on each respective body 210*a*, 210*b* to a respective fixed position stud 216*a*, 216*b*. As a result, body 210*a* tends to pivot in a clockwise direction and body 210*b* tends to pivot in a counterclockwise direction. Although elastic bands 218*a* and 218*b* are shown, one of ordinary skill in the art recognizes that the elastic members may alternatively be linear springs or the like.

The gripping surface 212*a*, 212*b* in the bodies 210*a*, 210*b* may be annular bands of a compressible material, such as a natural or synthetic rubber or other polymer. Alternatively, teeth or a textured surface may be used.

FIGS. 1A–2B show exemplary embodiments in which the pivoting means and opposing means are mirror images of each other; both include two pivoting bodies. Embodiments of the invention are also contemplated which include a single pivoting body.

Figure 3:
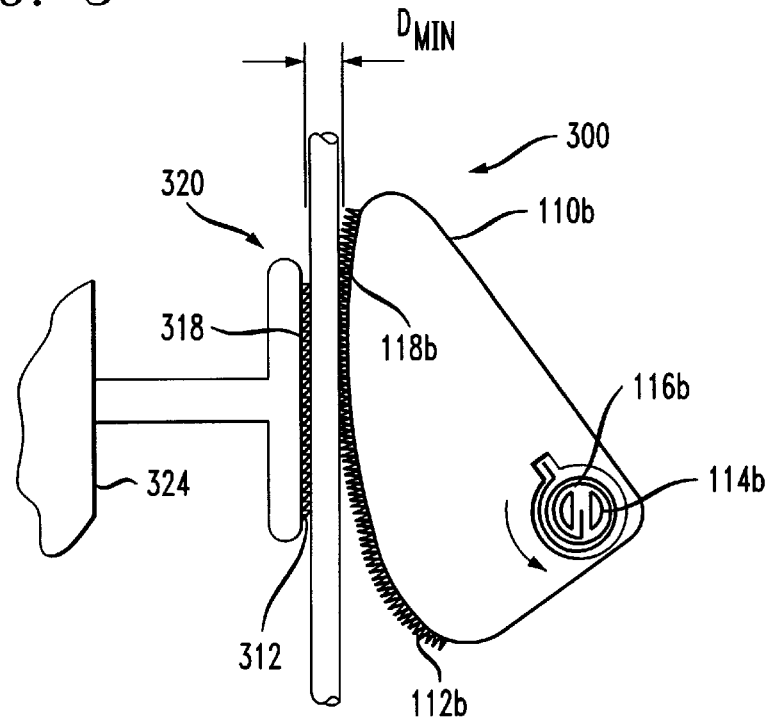
FIG. 3 is a plan view showing a third exemplary stress relief apparatus according to the invention.

FIG. 3 shows a third exemplary embodiment of the invention having a single pivoting body 110*b*. The stress relief apparatus 300 of FIG. 3 includes a pivoting means pivotally mounted to pivot about an axis. The pivoting means may be a body 110*b*, that is identical to the pivoting body 110*b* of FIGS. 1A and 1B; a description thereof is not repeated.

The opposing means 320 of apparatus 300 opposes pivoting of the pivoting body 110*b*. In this example, the opposing means 320 has a straight edge 318 with a gripping surface which may be teeth 312. The opposing means 320 may be fixedly mounted to a surface 324. The contour 318 of the body 320 may have a substantially straight section, or may be convex.

In a fashion similar to the embodiments of FIGS. 1A–2B, the conductor or cable 101 is insertable between the pivoting body 110*b* and the opposing body 320, so that a smallest distance between the pivoting body and the opposing body changes as the pivoting body 110*b* pivots.

FIG. 3 shows a single biasing means 116*b* for biasing at least one of the group consisting of the pivoting body 110*b* and the opposing body 320, so that the cable or conductor 101 is gripped between the pivoting body 110*b* and the opposing body 320.

Figure 4:
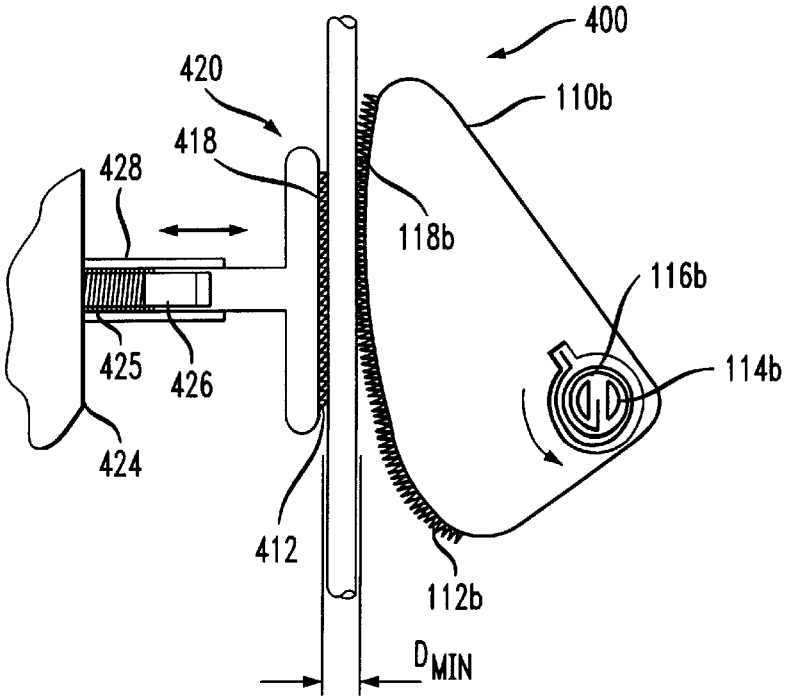
FIG. 4 is a plan view showing a variation of the stress relief apparatus according to FIG. 3.

FIG. 4 shows a variation of the embodiment of FIG. 3, having separate biasing means in the pivoting body 110*b* and the opposing body 420. The pivoting means may be a body 110*b*, that is identical to the pivoting body 110*b* of FIGS. 1A and 1B; a description thereof is not repeated.

The opposing means 420 of apparatus 400 opposes pivoting of the pivoting body 110*b*. In this example, the opposing means 420 has a straight edge 418 with a gripping surface which may be teeth 412. The opposing means 420 may be resiliently mounted to a surface 424. In this example, the resilient mounting includes a sleeve 428 with a cylinder 426 slidably mounted in the sleeve. A spring 425 biases the opposing body 420 to press the cable or conductor 101 against the pivoting body 110*b*. Although a spring 425 is shown, the biasing means may also be a soft, springy elastomeric cylinder or pad, or the like.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. Stress relief apparatus for an electrical connection of a conductor, comprising:

first and second bodies having respective first and second contours facing each other, the first and second bodies being mirror images of each other, the first and second bodies being pivotally mounted on separate pivot axes, so that a smallest distance between the first and second contours changes as the pivoting body pivots;

first and second bands of a compressible material arranged on the first and second bodies, respectively; and at least one elastic member which biases the pivotally mounted body, so that the bands of each of the first and second bodies engage a conductor positioned between the first and second bodies, thereby to relieve stress in the electrical connection of the conductor.

2. Stress relief apparatus for an electrical connection of a conductor, comprising:

first and second bodies having respective first and second contours facing each other, the first and second bodies being pivotally mounted, so that a smallest distance between the first and second contours changes as the pivoting bodies pivot;

first and second bands of a compressible material arranged on the first and second bodies, respectively;

first and second elastic members which bias the pivotally mounted bodies, so that each of the bands of the first and second bodies engage a conductor positioned between the first and second bodies, thereby to relieve stress in the electrical connection of the conductor; and first and second fixed-position studs, on which the respective first and second bodies are pivotally mounted, wherein the first and second elastic members connect the first and second bodies to the first and second fixed-position studs, respectively.

3. Stress relief apparatus according to claim 2, wherein the first and second bodies pivot in opposite directions from each other.

4. Stress relief apparatus according to claim 2, wherein the first and second elastic members bias the first and second bodies in opposite directions.

5. Stress relief apparatus according to claim 4, wherein the first and second elastic members bias the first and second bodies, respectively, so that the first and second bodies tend to pivot until the minimum distance between the first and second bodies is approximately the width or diameter of the conductor.

6. Stress relief apparatus according to claim 2, wherein the first and second bands are formed of a natural or synthetic rubber material.

7. Stress relief apparatus according to claim 2, wherein the bodies are circular and the bands are annular bands.

8. Stress relief apparatus according to claim 2, wherein the elastic member is a torsion spring.

9. Stress relief apparatus according to claim 2, wherein the first and second contours each include a portion which approximates a quadrant of an ellipse.

10. Stress relief apparatus for an electrical connection of a conductor, comprising:

first and second substantially circular bodies having respective first and second contours facing each other, at least one of the first and second bodies being pivotally mounted, so that a smallest distance between the first and second contours changes as the pivoting body pivots;

first and second annular bands of a compressible material arranged on the first and second bodies, respectively; and at least one elastic member which biases the pivotally mounted body, so that the annular bands of each of the first and second bodies engage a conductor positioned between the first and second bodies, thereby to relieve stress in the electrical connection of the conductor, further comprising first and second studs on which the bodies are pivotally mounted, the first and second studs positioned at a non-zero distance from the center of each respective body.

11. Stress relief apparatus according to claim 10, wherein the at least one elastic member includes first and second linear elastic members.

12. Stress relief apparatus for an electrical connection of a conductor, comprising:

a first pivoting body having a gripping edge, the first pivoting body being pivotally mounted to pivot about an axis;

a second pivoting body for opposing rotation of the first pivoting body, wherein the second pivoting body is a mirror-image of the first pivoting body, the second pivoting body positioned so that:

the conductor is insertable between the first pivoting body and the second pivoting body, and a smallest distance between the first pivoting body and the second pivoting body changes as the first pivoting body pivots;

first and second bands of a compressible material arranged on the first and second pivoting bodies, respectively; and biasing means for biasing at least one of the group consisting of the first pivoting body and the second pivoting body, so that the conductor is gripped between the first band of the first pivoting body and the second band of the second pivoting body, thereby to relieve stress in the electrical connection of the conductor.

13. Stress relief apparatus according to claim 12, wherein the first pivoting body includes a portion which approximates a quadrant of an ellipse.

14. Stress relief apparatus for a cable, comprising:

first and second pivoting means pivotally mounted for pivoting about first and second axes, respectively, so that a smallest distance between the first and second pivoting means changes as the first and second pivoting means pivot;

first and second bands of a compressible material arranged on the first and second means, respectively; and first and second biasing means for biasing the corresponding one of the first and second pivoting means, so that the band of each of the first and second pivoting means engages a cable positioned between the first and second pivoting means.

* * * * *